United States Patent [19]

Levine et al.

[11] Patent Number: 4,702,100

[45] Date of Patent: Oct. 27, 1987

[54] ADJUSTABLE CLEVIS

[76] Inventors: Richard M. Levine, 35179 Northmont, Farmington Hills, Mich. 48018; Stuart H. Levine, 4204 Cherryhill Dr., Orchard Lake, Mich. 48033; Leon Levine, 22353 Greenview, Southfield, Mich. 48075

[21] Appl. No.: 328,045

[22] Filed: Dec. 7, 1981

[51] Int. Cl.[4] ..... B21J 11/00

[52] U.S. Cl. ..... 72/404; 29/175 A; 403/158; 403/79

[58] Field of Search ..... 403/157, 158, 159, 79; 72/404; 29/175 A

[56] References Cited

U.S. PATENT DOCUMENTS

| | | | |
|---|---|---|---|
| 246,409 | 8/1881 | Moore et al. . | |
| 445,625 | 3/1891 | Williams . | |
| 445,631 | 3/1891 | Smith . | |
| 1,369,975 | 3/1921 | Johnson . | |
| 1,502,133 | 7/1924 | Anderson . | |
| 1,708,115 | 4/1929 | Baldwin | 29/175 A |
| 1,716,138 | 6/1929 | Johnson . | |
| 1,930,346 | 10/1933 | Manson . | |
| 2,022,801 | 12/1935 | Conner . | |
| 2,288,151 | 6/1942 | Alexander . | |
| 2,480,958 | 9/1949 | Pietzsch | 403/79 |
| 2,559,741 | 7/1951 | Wachsmann . | |
| 2,883,216 | 4/1959 | Nock . | |
| 3,501,828 | 3/1970 | Schultz . | |
| 4,159,187 | 6/1979 | Cale . | |
| 4,172,676 | 10/1979 | De Chant . | |

FOREIGN PATENT DOCUMENTS

| | | | |
|---|---|---|---|
| 113587 | 3/1945 | Sweden | 403/159 |
| 1343265 | 1/1974 | United Kingdom | 403/157 |

*Primary Examiner*—Andrew V. Kundrat

*Attorney, Agent, or Firm*—Krass & Young

[57] ABSTRACT

An adjustable clevis includes a pair of opposed, spaced clevis members each having one end thereof secured to a cylindrical body. The body may consist of a threaded bore or a threaded stud to permit coupling with the male or female components of a linkage or the like. The clevis members are formed by passing a sheet of metal through a progressive die which shears and coins blanks into a configuration consisting of an outer perforated ear and an arcuate base having an inner curved surface which conformingly engages the body and is off-set relative to the ear.

1 Claim, 8 Drawing Figures

ADJUSTABLE CLEVIS

DESCRIPTION

1. Technical Field

The present invention generally relates to fastening devices and linkage mechanisms, and deals more particularly with a novel clevis assembly and method for making the same.

2. Background Art

Clevis devices have long been employed to provide pivotable connections in mechanical linkages. Many prior art clevis devices include a main body which is threaded so as to permit adjustment of the position of the clevis relative to one portion of the linkage to which it is connected.

One typical application of a clevis of the type described above is in the automotive field in which the clevis is employed to connect control rods to the clutch and transmission of a vehicle. In the past, these clevis devices were of unitary construction and were manufactured by hot forging techniques. This manufacturing approach is not particularly cost effective because of the expense of the time and equipment required to heat and forge the constituent metal.

There is therefore a need in the art for an improved clevis construction which is equivalent in strength and reliability to the prior art hot forged clevis but which offers improved manufacturing economy.

DISCLOSURE OF THE INVENTION

Accordingly, it is a primary object of the present invention to provide an improved clevis of the adjustable type which obviates each of the shortcomings mentioned above. The clevis of the present invention includes a pair of opposed, spaced apart clevis members each having one end thereof secured to a cylindrically shaped body. The body may consist of a threaded bore or a threaded stud to permit coupling with the male or female components of a linkage or the like. The clevis members are formed by passing a sheet of metal through a progressive die which shears and coins blanks into a configuration consisting of an outer perforated ear and an arcuate base having an inner curved surface which conforms to the base and is off-set relative to the ear. The clevis members are joined to the body by welding or the like.

BRIEF DESCRIPTION OF THE DRAWINGS

In the drawings, which form an integral part of the specification and are to be read in conjunction therewith, and in which like reference numerals are employed to designate identical components in the various views.

BEST MODE FOR CARRYING OUT THE INVENTION

Figure 1:
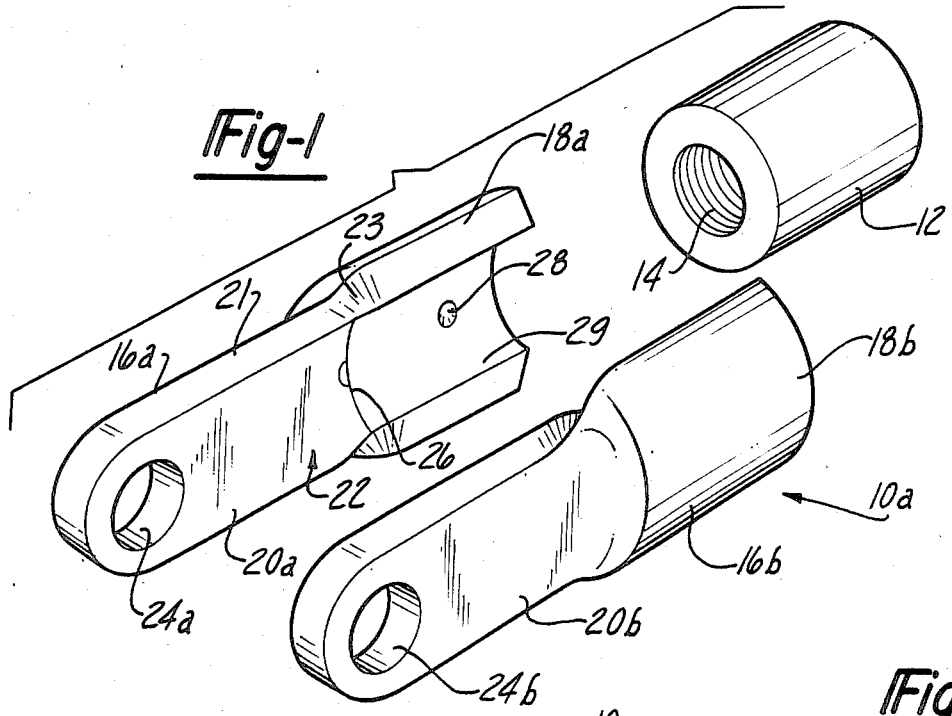
FIG. 1 is a perspective, exploded view of one of the preferred embodiments of the present invention.
Figure 2:
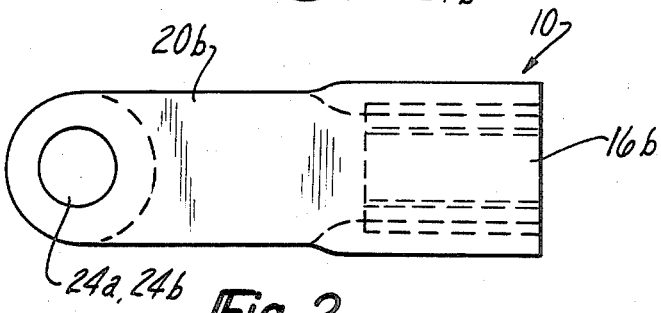
FIG. 2 is a side view of the clevis shown in FIG. 1, in an assembled state.
Figure 3:
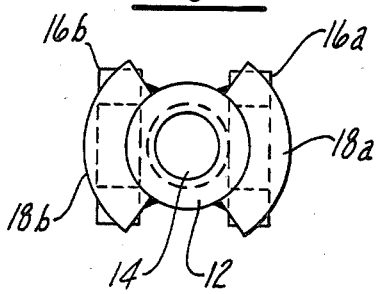
FIG. 3 is a rear view of the clevis shown in FIGS. 1 and 2.

Referring first to FIGS. 1–3, the present invention is broadly concerned with an adjustable clevis, generally indicated by the numeral 10*a*, which comprises a cylindrically shaped body 12 and a pair of clevis or connecting members 16*a* and 16*b* respectively.

Body 12 includes a theaded bore 14 longitudinally therethrough which is adapted to receive the male component of linkage (not shown) to be coupled with the clevis 10*a*. By virtue of the threaded bore 14, the male component of the linkage may be turned relative to the clevis 10*a*, thereby to render the clevis 10 longitudinally adjustable relative to the linkage.

Each of the clevis members 16*a*, 16*b* includes a base 18*a*, 18*b* and a pair of laterally spaced ears 20*a* and 20*b* which extend forwardly beyond the body 12. Bases 18*a*, 18*b* each include a curved inner surface 29 having a curvature adapted to conformingly engage the cylindrical surface of body 12. The body 12 is disposed between clevis members 16*a* and 16*b*, and more particularly between the opposed curved surfaces 29 of the bases 18*a*, 18*b*. The bases 18*a*, 18*b* are secured to body 12 as by welding. A welding dimple 28 in surfaces 29 may be provided to facilitate and improve the weld.

Ears 20*a*, 20*b* include opposed, parallel surfaces 22 which are separated, and off-set radially inward, from the curved inner surfaces 29 at a transition line 26. It may therefore be appreciated that the distance between opposed surfaces 22 is less than the outer diameter of body 12. Ears 20*a* and 20*b* include aligned apertures 24*a*, 24*b* at the respective outer extremities thereof. Apertures 24*a*, 24*b* are adapted to couple with another portion of the linkage using a bolt (not shown) or the like. The outer surfaces of clevis members 16*a* and 16*b* are broadly similar in contour to the inner surfaces thereof. The edges 21 of clevis members 16*a*, 16*b* are twisted through a predefined arc at a transition point 23.

Figure 4:
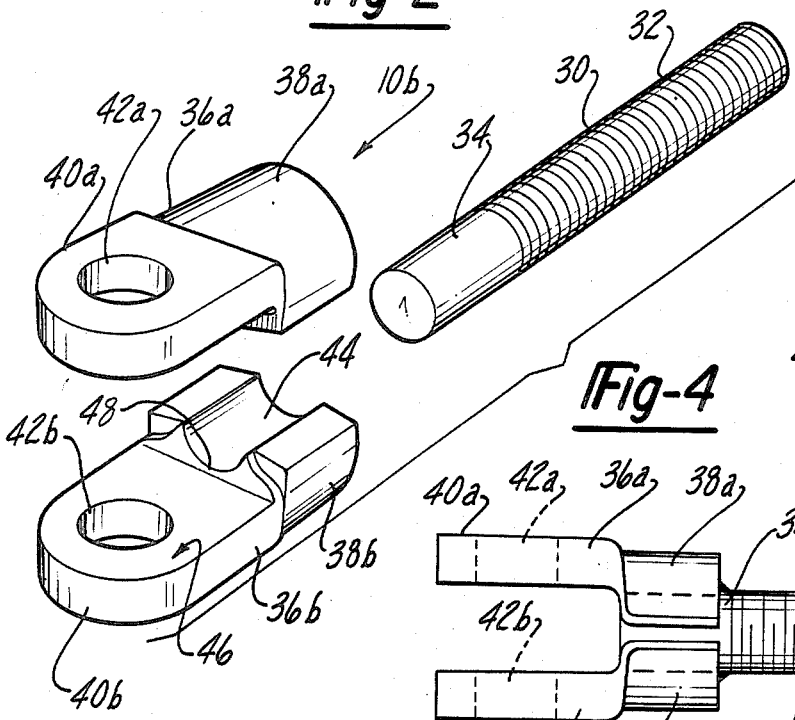
FIG. 4 is a perspective, exploded view of another form of the preferred embodiment of the present invention.
Figure 5:
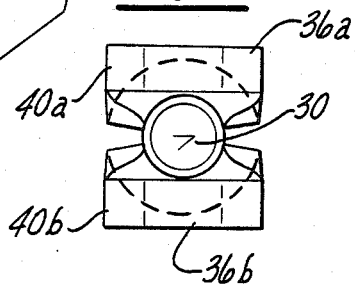
FIG. 5 is an end view of the clevis shown in FIG. 4, in an assembled state.
Figure 6:
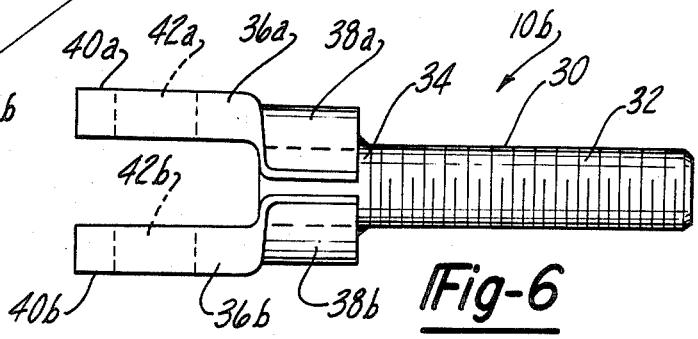
FIG. 6 is a side view of the clevis shown in FIGS. 4 and 5.

Another form of the adjustable clevis, broadly indicated by numeral 10*b* is depicted in FIGS. 4–6. Clevis 10*b* includes a body 30 defined by a shaft, one extremity of which is threaded at 32, the other extremity thereof being essentially smooth. A pair of discrete clevis members 36*a*, 36*b* are joined as by welding to the smooth portion 34 of body 30.

Clevis members 36*a*, 36*b* include bases 38*a*, 38*b* having arcuate inner surfaces 44 adapted to conformingly engage the smooth portion 34 of body 30. A pair of laterally spaced ears 40*a*, 40*b* extend forwardly from bases 38*a*, 38*b* beyond the smooth portion 34 of body 30. Ears 40*a*, 40*b* include parallel, spaced apart essentially flat surface areas 46 in which there is provided aligned apertures 42*a*, 42*b*.

The inner, arcuate surface areas 44 are radially spaced inwardly from the flat surface areas 46 to define a transition line at 48. It may thus be appreciated that the distance between the surface areas 46 of ears 40*a*, 40*b* is greater than the outside diameter of body 30.

As will be discussed herein below, clevis members 16*a*, 16*b*, 36*a*, 36*b* may be stamped from a conventional 1008 or 1010 sheet steel.

Figure 7:
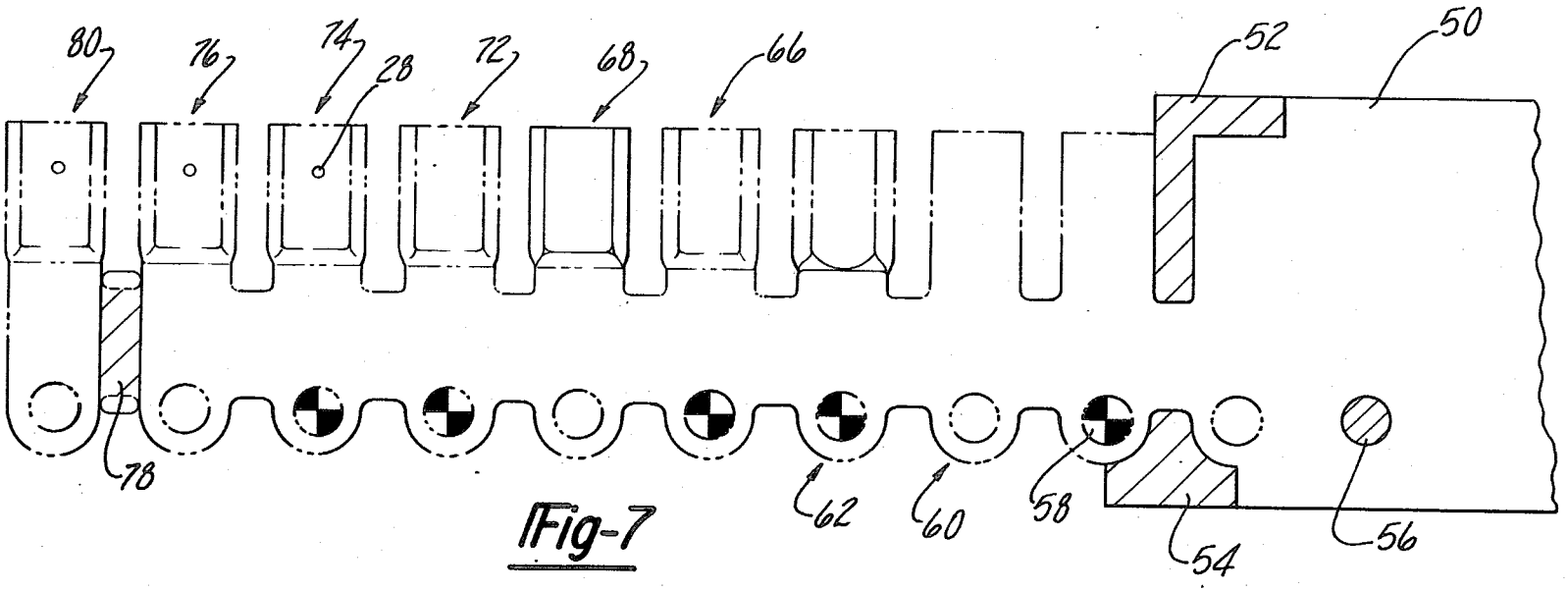
FIG. 7 is a diagrammatic plan view of a progressive die in which a sheet of metal is being operated upon to produce the clevis members.
Figure 8:
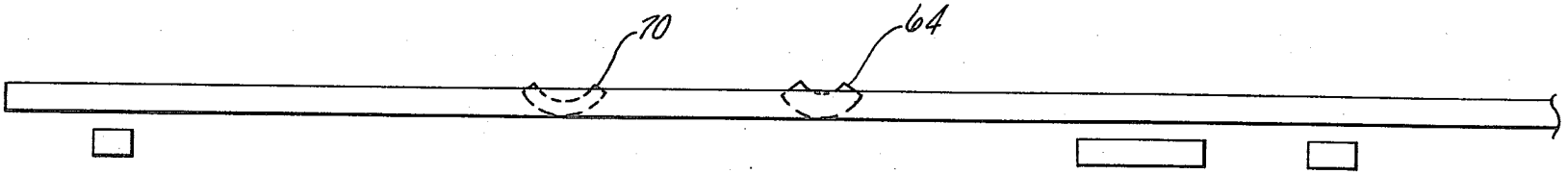
FIG. 8 is a diagrammatic end view of partially formed clevis member at two of the operating stations of the die shown in FIG. 7.

Referring now also to FIGS. 7 and 8, the clevis members 16*a*, 16*b*, 36*a*, 36*b* may be formed from a sheet 50 of suitable steel having a thickness, by way of example, of 0.281 inches. The sheet 50 may be in the form of a coil which is unrolled and trained into a progressive die having a plurality of operating stations driven by a single press. With each cycle of the press, the sheet 50 is advanced through the die between a plurality of operating stations which will be discussed below. Each of the operating stations includes a metal working tool for operating on the sheet 50. The first station includes a punch 56 which forms the apertures 24*a*, 24*b*, 42*a*, 42*b*, which apertures are later used at subsequent operating stations to maintain the partially formed clevis members in proper registration within the die. The next operating station consists of a pair of shear members 52 and 54 respectively which function to shear a portion of the sheet 50 so as to define a substantial portion of the periphery of each clevis member. The blank produced by the punch 56 and shearing members 52 and 54 is then advanced linearly to an idle station 60, thence to a first forming station 62 in which the base of the clevis member is partially formed by coining, i.e., using an appropriately shaped die which is forced by the press into engagement with the blank. A series of spaced pins 58 extend through the aperture in the blanks made by the punch 56 so as to maintain the sheet 50 in proper registration as it travels through the die.

As best seen in FIG. 8 the base portion indicated at 64 of the clevis member is partially formed to the desired shape, however, the full radius of the inner curved surface 29 has not yet been developed at this point.

The partially formed clevis member is then delivered to a second forming station 68 where forming of the base is completed by coining to produce the off-set in the curved surface 29 relative to the flat surface 22. The clevis member is then delivered through another pilot station 72 to a third pilot station indicated by the numeral 74 where an appropriately shaped tool coins the dimple 28 in surface 29. Next, the clevis member is delivered through an idle station 76 to a cut-off station 80 where an additional shearing member 78 driven by the press shears the remaining portion of the periphery of the clevis member in order to complete the manufacturing operation.

From the foregoing, it can be appreciated that a novel method of manufacturing a clevis has been disclosed consisting of the steps of: providing a substantially flat sheet of substantially rigid, formable material; cutting a portion of the sheet to define a substantial part of the periphery of the clevis members; forming a through-hole in the clevis members; forming the conforming surfaces of the clevis members, and; then, cutting the remaining portion of the sheet to define the remaining part of each clevis member.

In light of the foregoing, it may be appreciated that the adjustable clevis device and method for producing same not only provide for the reliable accomplishment of the objects of the invention but do so in a particularly efficient and cost effect manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

We claim:

1. A method of manufacturing a clevis of the type having a main body and a pair of discrete, opposed clevis members each having a surface conforming to said body and an ear extending outwardly beyond said body, comprising the following steps, performed in succession at the operating stations of a progressive die:

(A) providing a substantially flat sheet of substantially rigid, formable material;

(B) forming a series of through-holes at spaced points along said sheet;

(C) shearing a portion of said sheet to define a substantial part of the periphery of said clevis members;

(D) forming said conforming surface of each of said clevis members by coining a portion of said sheet;

(E) then, shearing the remaining portion of said sheet to define the remaining part of said clevis member.

* * * * *